US012781610B1

(12) United States Patent
Al-Sulaiman et al.

(10) Patent No.: US 12,781,610 B1
(45) Date of Patent: Nov. 3, 2026

(54) FORMATION FRACTURE PRODUCTION AND INJECTION CONTROL FOR BETTER WELL PERFORMANCE

(71) Applicant: SAUDI ARABIAN OIL COMPANY, Dhahran (SA)

(72) Inventors: Mustafa Al-Sulaiman, Dhahran (SA); Hesham Al-Omair, Dhahran (SA); Mortada Al-Kadem, Dhahran (SA); Ammar Al-Khuwaildi, Dhahran (SA); Ahmed Wagia Alla, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 19/221,945

(22) Filed: May 29, 2025

(51) Int. Cl.
*E21B 43/267* (2006.01)
*E21B 33/138* (2006.01)

(52) U.S. Cl.
CPC ..... *E21B 43/267* (2013.01); *E21B 33/138* (2013.01)

(58) Field of Classification Search
None
See application file for complete search history.

(56) References Cited

U.S. PATENT DOCUMENTS

| | | | | |
|---|---|---|---|---|
| 5,218,038 | A | 6/1993 | Johnson et al. | |
| 7,598,209 | B2 | 10/2009 | Kaufman et al. | |
| 7,963,330 | B2 | 6/2011 | Nguyen et al. | |
| 10,550,306 | B2 | 2/2020 | Rama et al. | |
| 2008/0108520 | A1 | 5/2008 | Fu et al. | |
| 2009/0099047 | A1* | 4/2009 | Cunningham | C09K 8/516 507/269 |
| 2010/0243242 | A1* | 9/2010 | Boney | E21B 43/26 166/278 |
| 2013/0186688 | A1* | 7/2013 | Rasmus | E21B 43/26 175/48 |

(Continued)

FOREIGN PATENT DOCUMENTS

| | | | |
|---|---|---|---|
| CN | 107109916 | A | 8/2017 |

OTHER PUBLICATIONS

Cheung, Bettina, et al., Impact of Low Cost Proppant and Fluid Systems in Hydraulic Fracturing of Unconventional Wells, Paper presented at the Abu Dhabi International Petroleum Exhibition & Conference, Abu Dhabi, UAE, Nov. 2018.

(Continued)

*Primary Examiner* — Andrew Sue-Ako
(74) *Attorney, Agent, or Firm* — Vorys, Sater, Seymour and Pease LLP

(57) ABSTRACT

A method for addressing fractured subterranean formations includes reducing permeability in fractures in the formation rather than sealing the fractures all together. The methods include pumping a proppant slurry comprising resin-coated sand and a carrier into the fractures at a controlled pressure such that the fractures are elastically dilated to accommodate the proppant. Once the pumping pressure is relieved, the carrier fluid may flow back allowing the fractures may elastically retract, thereby holding the proppant in place. The proppant is selected for characteristics such as roundness that allow the proppant to form a matrix with a permeability similar to, or within a predetermined range of, a permeability of the surrounding formation.

14 Claims, 4 Drawing Sheets

(56) References Cited

U.S. PATENT DOCUMENTS

| | | | | |
|---|---|---|---|---|
| 2015/0075787 | A1* | 3/2015 | Davidson | E21B 49/008 166/308.1 |
| 2016/0139588 | A1 | 5/2016 | Huang et al. | |
| 2018/0209260 | A1 | 7/2018 | Hwang et al. | |
| 2020/0355055 | A1* | 11/2020 | Dusterhoft | E21B 43/26 |
| 2024/0360749 | A1 | 10/2024 | Patil et al. | |

OTHER PUBLICATIONS

Bandara, K.M.A.S., et al., Proppant Crushing Mechanisms Under Reservoir Conditions: Insights into Long-Term Integrity of Unconventional Energy Production. Nat Resour Res 28, 1139-1161 (2019).
Bandara, K. M. A. S., et al., Influence of Proppant Behavior on Unconventional Oil/Gas Recovery, Paper presented at the 54th U.S. Rock Mechanics/Geomechanics Symposium, physical event cancelled, Jun. 2020.
Wang H, et al., A New Coated Proppant for Packing Fractures in Oil Reservoirs. Coatings. 2023; 13(7): 1238.
Buitrago B., et al., Characterization of naturally fractured reservoirs. SPE Reprint Series, (2001) SPE 69538.

* cited by examiner

FORMATION FRACTURE PRODUCTION AND INJECTION CONTROL FOR BETTER WELL PERFORMANCE

FIELD OF THE DISCLOSURE

The present disclosure relates generally to operations conducted in a wellbore extending through a fractured zone in a subterranean formation, and more particularly to addressing difficulties associated with the fractured zones such as preventing or alleviating the loss of drilling fluids and other well servicing fluids into the subterranean formation.

BACKGROUND OF THE DISCLOSURE

Wellbores may be drilled to recover natural deposits of oil and gas, as well as other desirable materials that are trapped in subterranean geological formations. Drilling fluids are often circulated through a wellbore to facilitate the drilling process. For example, the drilling fluids may suspend cuttings, control pressure, stabilize the wellbore, cool and lubricate a drill string and drill bit, and transmit hydraulic power to the drill bit.

One significant difficulty in drilling wellbores is a loss of the drilling fluid to the surrounding formation. Loss of the drilling fluid, commonly referred to as "lost circulation," arises from drilling a wellbore into geological formations that are fractured, cavernous, under-pressured, or highly permeable, such as those with a permeability greater than 100 Darcys. In some instances, a total loss of drilling fluid may occur, where none of the drilling fluid returns to the surface, which typically necessitates abandoning the wellbore.

Typically, lost circulation in wellbores is addressed by sealing the geological voids, or "fractures," either chemically or mechanically. The effectiveness of these solutions is often only temporary, and the effects of the fractures may affect wellbore performance over the life of the wellbore. For example, once drilling is complete, water or other unwanted fracture fluids penetrate the sealed fractures and may migrate into the wellbore. The water and other fracture fluids may disrupt the production of hydrocarbons and more desirous fluids.

Accordingly, a sustainable solution to address fractured formations surrounding a wellbore may benefit the drilling, completion and production over the entire life of a wellbore.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a method for reducing a permeability of a fractured formation zone through which a wellbore extends includes the steps of (a) identifying the fractured formation zone in the wellbore, the fractured formation zone including at least one fracture extending into a geologic formation surrounding the wellbore, (b) determining a fracture dilation pressure at which the at least one fracture may or would receive a fluid and a fracture propagation pressure at which the at least one fracture may or would be extended, (c) selecting a proppant including a resin-coated sand configured to form a proppant matrix with a permeability within a predetermined range of a matrix permeability of the geologic formation surrounding the wellbore, (d) running a tubular conveyance into the wellbore, the tubular conveyance carrying at least one isolation member, (e) isolating a portion of the wellbore containing the at least one fracture by actuating the isolation member to engage the geologic formation and seal a boundary of the wellbore portion, (f) pumping a proppant slurry comprising the selected proppant and a carrier fluid through the tubular conveyance into the isolated wellbore portion at a pumping pressure that is greater than the fracture dilation pressure and less than the fracture propagation pressure, wherein the pumping pressure elastically dilates the at least one fracture to permit the proppant slurry to be injected therein and (g) discontinuing the pumping to allow the carrier fluid to flow back from the isolated wellbore portion, whereby the at least one fracture elastically contracts to secure the proppant in place and form a proppant matrix that reduces the permeability of the fractured formation zone.

According to another example embodiment consistent with the present disclosure, a system for reducing the permeability of a fractured formation zone through which a wellbore extends includes a tubular conveyance configured for insertion into the wellbore and at least one isolation member carried by the conveyance and actuatable to isolate a wellbore portion containing at least one fracture extending into a surrounding geologic formation. A source of a proppant slurry is fluidly coupled to the tubular conveyance, the proppant slurry including a selected proppant and a carrier fluid wherein the proppant is selected to form a proppant matrix that reduces the permeability of the fractured formation zone. The system also includes a pump operable to deliver the proppant slurry from the source to the wellbore portion isolated by the at least one isolation member at a pumping pressure that is i) greater than a fracture dilation pressure at which the at least one fracture would receive the proppant slurry therein and ii) less than a fracture propagation pressure at which the at least one fracture would be extended.

According to still another example embodiment consistent with the present disclosure, a method for reducing a permeability of a fractured formation zone through which a wellbore extends includes (a) selecting a proppant including a resin-coated sand configured to form a proppant matrix with a permeability within a predetermined range of a matrix permeability of the geologic formation surrounding the wellbore, (b) running a tubular conveyance into the wellbore, the tubular conveyance carrying at least one isolation member, (c) isolating a portion of the wellbore containing the at least one fracture by actuating the isolation member to engage the geologic formation, (d) pumping a proppant slurry comprising the selected proppant and a carrier fluid through the tubular conveyance into the isolated wellbore portion (e) injecting the selected proppant into the at least one fracture by pressurizing the proppant slurry in the isolated wellbore portion with a pumping pressure that is less than the fracture propagation pressure at which at least one fracture would be extended and (f) forming a proppant matrix within the at least one fracture with the selected proppant, wherein the proppant matrix reduces the permeability of the fractured formation zone.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
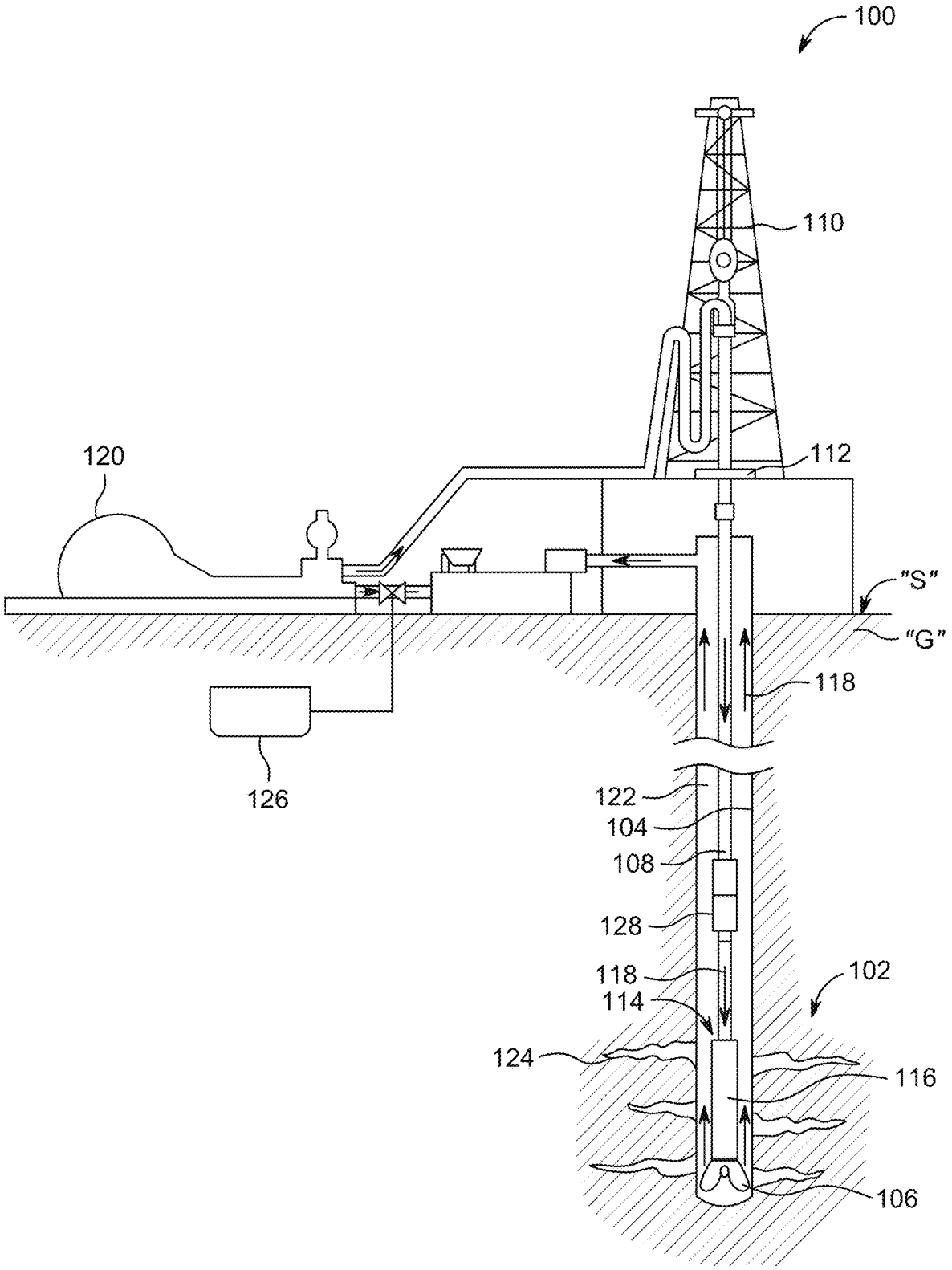
FIG. 1 is a schematic illustration of an example wellbore drilling system encountering a fractured formation zone in accordance with at least one aspect of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

According to aspects of the present disclosure, a method for addressing formation fractures encountered in wellbore operations includes reducing permeability in the fractured formation zone. The method may include isolating a fracture in a wellbore with a straddle packer carried by a drill string (for new wellbores) or a coiled tubing (for existing wellbores). Proppants and slick water (a water-based fluid including a friction reducer) may be pumped into the fracture at a pressure sufficient to elastically expand the fracture without further propagating (extending) the fracture. The slick water may be flowed back into wellbore to permit the fracture to shrink and secure the proppants in place. The proppants may include resin coated sand that acts a permeability reducer within the fracture. The proppants secured within the fractures may provide a permeability within a predetermined range, which may be at or near a permeability of the surrounding formation. In a dry oil zone, the proppants may facilitate an equalized drawdown, in a mature well, the proppants may be used jointly with mechanical sealants to reduce water coning, and in injection wells, the proppants may be used to equalize thief zones. In some embodiments, inflow control devices or other devices may be installed to further equalize flow along the wellbore.

FIG. 1 illustrates an example of a drilling system 100 that may encounter a fractured formation zone 102 in accordance with one or more exemplary embodiments of the disclosure. The drilling system 100 is partially disposed within a wellbore 104 extending from a surface location "S" and traversing a geologic formation "G." In the illustrated example, the wellbore 104 is shown generally vertical, though it will be understood that the wellbore 104 may include any of a wide variety of vertical, directional, deviated, slanted and/or horizontal portions therein, and may extend along any trajectory through the geologic formation "G."

A drill bit 106 is provided at a lower end of a drill string 108 for cutting into the geologic formation "G." When rotated, the drill bit 106 operates to break up and generally disintegrate the geological formation "G." The drill bit 106 may be rotated in any of a variety of ways. In this example, at the surface location "S" a drilling rig 110 includes a turntable 112 that may be operated to rotate the entire drill string 108 and the drill bit 106 coupled to the lower end of the drill string 108. The turntable 112 may be selectively driven by an engine, chain-drive system, or other apparatus (not shown). In some embodiments, a bottom hole assembly or BHA 114 provided in the drill string 108 may include a downhole motor 116 to selectively rotate the drill bit 106 with respect to the rest of the drill string 108. The motor 116 may generate torque in response to the circulation of a drilling fluid, such as mud 118, therethrough. As those skilled in the art will recognize, the ability to selectively rotate the drill bit 106 relative to the drill string 108 may be useful in directional drilling, and/or for other operations as well.

The mud 118 can be pumped downhole by mud pump 120 through an interior of the drill string 108. The mud 118 passes through the downhole motor 116 of the BHA 114 where energy is extracted from the mud 118 to turn (rotate, operate, etc.) the drill bit 106. As the mud 118 passes through the BHA 114, the mud 118 may lubricate bearings (not explicitly shown) defined therein before being expelled through nozzles (not explicitly shown) defined in the hybrid drill bit 102. The mud 118 flushes geologic cuttings and/or other debris from the path of the drill bit 106 as it continues to circulate back up through an annulus 122 defined between the drill string 108 and the geologic formation "G." The geologic cuttings and other debris are carried by the mud 118 to the surface location "S" where the cuttings and debris can be removed from the mud stream.

As the wellbore 104 extends into the fractured formation zone 102, an operator may notice that a portion of the mud 118 pumped through the drill sting 108 does not return to the surface location "S." A portion of the mud 118 may be lost to at least one fracture 124 defined within the fractured formation zone. As used throughout this disclosure, the term "fractured formation zone" refers to a portion of the geological formation "G" into which drilling mud 118 or other fluids circulating through the wellbore 104 can be lost due to fractures 124 in the geologic formation "G." A fractured formation zone 102 may commonly be identified during a drilling operation in response to a loss of drilling mud 118, but those skilled in the art may recognize that a fractured formation zone 102 may develop after drilling is completed and may be identified in a variety of other methods without departing from the scope of the disclosure.

In some embodiments, the system 100 may include a source 126 of a proppant slurry including a proppant 210 (FIG. 2B) and a carrier fluid selected to reduce the permeability of the fractured formation zone 102 in accordance with aspects of the present disclosure. The source 126 of proppant slurry may be selectively pumped into the wellbore 104 through the drill string 108 or another conveyance. The source 126 may include a proppant injection pump configured to accommodate the viscous and abrasive nature of the proppant slurry. In some embodiments, the drill string 108 may carry at least one isolation member 128 thereon that is selectively actuatable to engage the geologic formation "G" to isolate a portion of the wellbore 104 through which the proppant slurry may be injected into the fractures 124 as described in greater detail below.

Figure 2A:
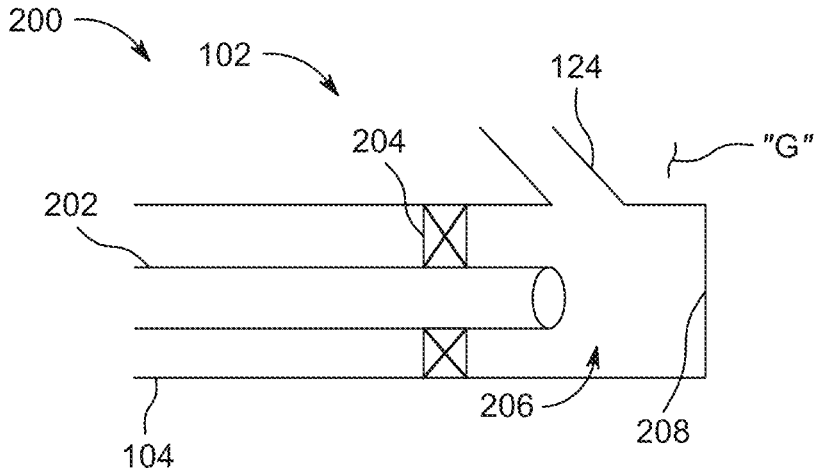
FIGS. 2A, 2B and 2C are sequential schematic views illustrating a procedure for reducing the permeability of the fractured formation zone of FIG. 1 with a tubular conveyance in accordance with one or more aspects of the present disclosure.
Figure 2B:
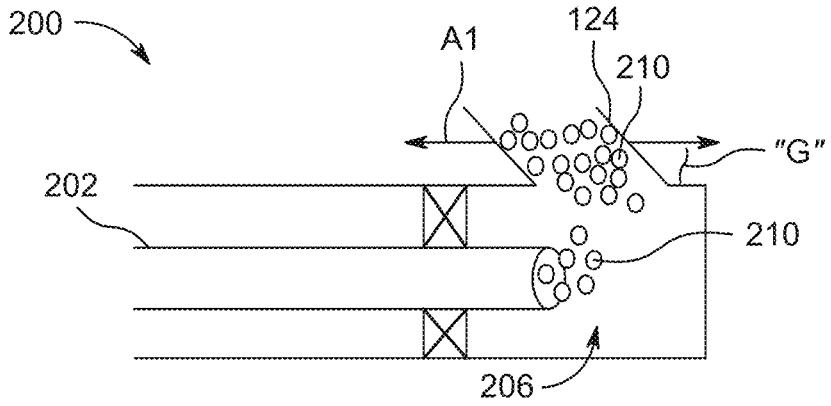
Figure 2C:
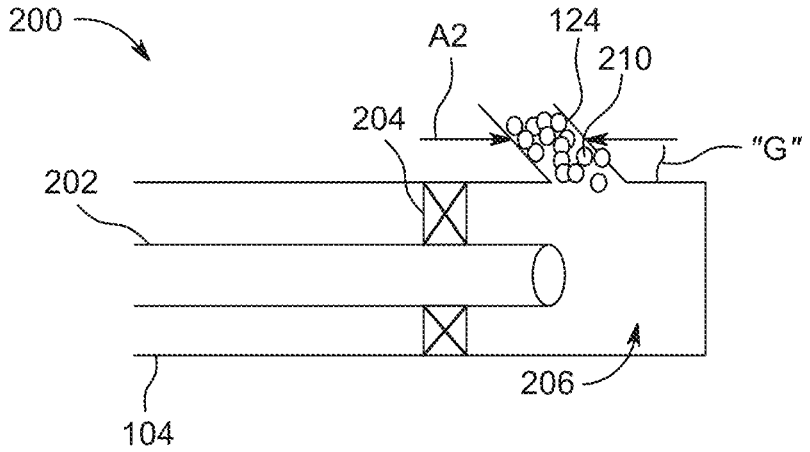

Referring now to FIGS. 2A, 2B and 2C, a procedure for addressing the fractured formation zone 102 with an injection system 200 is illustrated. The procedure by reducing the permeability of at least one fracture 124 is illustrated. Initially, once the fractured formation zone 102 is encountered (identified), the drill string 108 (FIG. 1) may be pulled (tripped) out of the wellbore 104 and a conveyance 202 may be run in, as illustrated in FIG. 2A. As described in greater detail below, the procedure may also be implemented in existing wellbores (previously drilled) where the location of a fractured formation zone is known.

The conveyance 202 may include a coiled tubing string, a drill string or other types of tubular conveyances known in the art. An isolation member 204 carried by the conveyance 202 may be radially expanded to engage the geologic formation "G" and isolate a portion 206 of the wellbore 104 in which the at least one fracture 124 is located. The isolation member 204 may include an inflatable packer, a straddle packer, a plug, a valve or other types of isolation mechanisms recognized in the art. In the embodiment illustrated in FIG. 2A, the isolated portion 206 of the wellbore 104 extends to a toe 208 or bottom of the wellbore 104. In other embodiments, other portions of the wellbore 104 may be isolated that are remote from the toe 208 without departing from the scope of the disclosure.

As illustrated in FIG. 2B, proppants 210 may be injected into the isolated portion 206 through the conveyance 202. The proppants 210 may be injected with slick water or another carrier at a predetermined pressure. For example, the predetermined pressure may be greater than a formation pressure (e.g., a pore pressure) of the fractured formation zone 102, but lower than a fracture propagation pressure that would further extend the fracture 124. The formation pressure and fracture propagation pressure may be determined empirically by laboratory tests with geologic samples collected from the fractured formation zone 102. The identified predetermined pressure range may allow the fracture 124 to dilate in the direction of arrows A1 and accommodate the proppant 210 without further extending the fracture 124. In some embodiments, the proppants 210 may be pumped hundreds of feet or more into the fracture 124.

In some embodiments, the proppants 210 may include a resin-coated sand. In some embodiments, a high-viscosity resin may be selected where the fracture 124 is relatively wide to ensure adequate proppant suspension and fracture stability. Where the fracture 124 is relatively long, low viscosity resins with high flowability may be selected. Resins with improved rheological properties may be selected for complex fracture networks. The resin may be selected based on the characteristics of the fracture 124. The resin coating on the sand may help to hold the proppants 210 in place once the proppants 210 enter the fracture 124 and may serve as a permeability reducer. For example, the amount of resin coating may be selected such that the proppant 210 within the fracture 124 exhibits a permeability approximately equal, or within a predetermined range from, a matrix permeability of the geologic formation "G" surrounding the fracture 124. In some embodiments, a roundness of the proppants 210 may be selected to provide the desired permeability as described in greater detail below. In some embodiments, the proppants 210 may be selected to provide a permeability within 10%, 20% or 30% of the matrix permeability. In other embodiments, the proppants 210 may be selected to provide any decrease in permeability within the fracture 124.

Referring to FIG. 2C, once the proppant 210 has been injected into the fracture 124, the pumping pressure may be alleviated (reduced) to permit the slick water or carrier fluid to flow back. The fracture 124 may elastically contract in the direction of arrows A2 to hold the proppants 206 in place. Once the fracture 124 has contracted, the isolation member 204 may be retracted and the conveyance 202 may then be removed from the wellbore 104. If the wellbore 104 has not yet been completed, the drill string 108 (FIG. 1) may be returned to the wellbore 104 and drilling may continue.

Figure 3A:
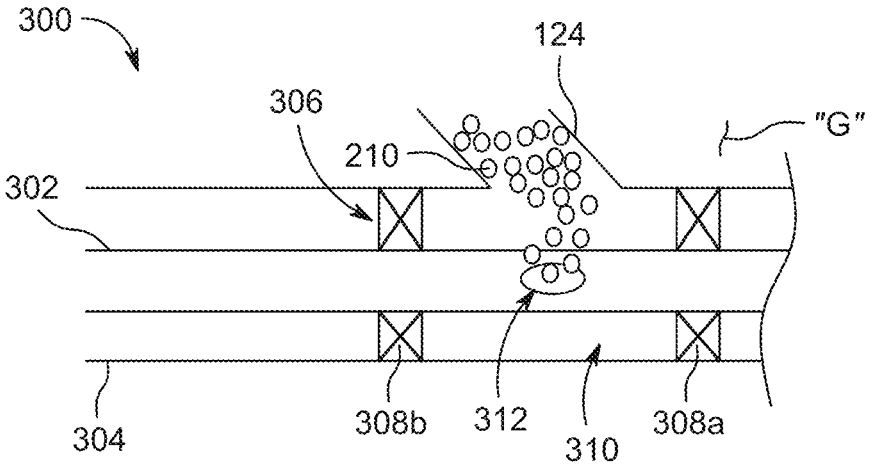
FIGS. 3A and 3B are schematic views of alternate tubular conveyances that may be employed to implement procedures for reducing permeability.

FIG. 3A is a schematic view of an alternate tubular conveyance 302 that may be employed to implement procedures consistent with the present disclosure. The tubular conveyance 302 may be run into an existing or previously drilled wellbore 304. The conveyance 302 may include coiled tubing or another type of tubular tool string. The conveyance 302 carries a straddle packer 306 including a downhole isolation member 308*a* and an uphole isolation member 308*b*. The isolation members 308*a*, 308*b* may be radially expanded to engage the geologic formation "G" on opposite sides of at least one fracture 124 and thereby isolate a portion 310 of the wellbore 304 in which the at least one fracture 124 is located. A fluid port 312 is provided between the downhole and uphole isolation members 306*a*, 306*b* to allow for fluid communication between an interior of the conveyance 302 and the isolated portion 310 of the wellbore 302.

The proppants 210 may be pumped down through the conveyance 302 with slick water and may be injected into the fracture 124 through the fluid port 312. The fracture 124 may be elastically dilated and contracted as described above such that the proppants are secured within the fracture 124. The straddle packer 306 may then be conveyed to another location in the wellbore 304 to inject additional proppants (similar and/or different than the proppants 210) into an additional fracture 124.

Where the wellbore 304 is in a matured zone, the proppants 210 may be injected with mechanical sealants to delay water breakthrough as well as reduce the water coning. These mechanical sealants can include polymers, epoxies, or other specialized materials designed to effectively plug microfractures in the geologic formation "G." Since the proppants 210 may have a permeability near a matrix permeability of the surrounding geologic formation "G," the fracture 124 may act as part of the matrix, which will reduce water production and control the water production after water encroachment occurs.

Figure 3B:
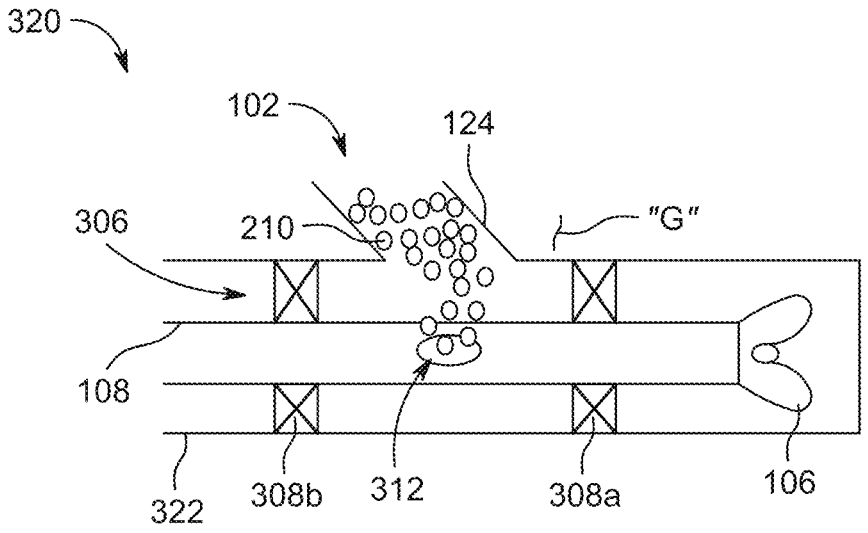

FIG. 3B is a schematic view of an alternate injection system 320 including the straddle packer 306 carried by the drill string 108. The injection system 320 may be employed in a wellbore 322 being drilled with the drill bit 106 coupled below (downhole from) the straddle packer 306. When the drill bit 106 encounters a fractured formation zone 102, drilling may be discontinued and one or both of the isolation members 308*a*, 308*b* may be radially expanded to sealingly engage the geologic formation "G." Proppants 210 and slick water may be pumped down the drill string 108 and into the fracture 124 through the fluid port 312. The slick water may be permitted to flow back so that the proppants are secured within the fracture 124 as described above. The isolation members 308*a*, 308*b* may be retracted, and then drilling may continue with the drill bit 106. In this way, the proppants 210 may be injected without withdrawing (running out) the drill string 108 from the wellbore 322.

Figure 4:
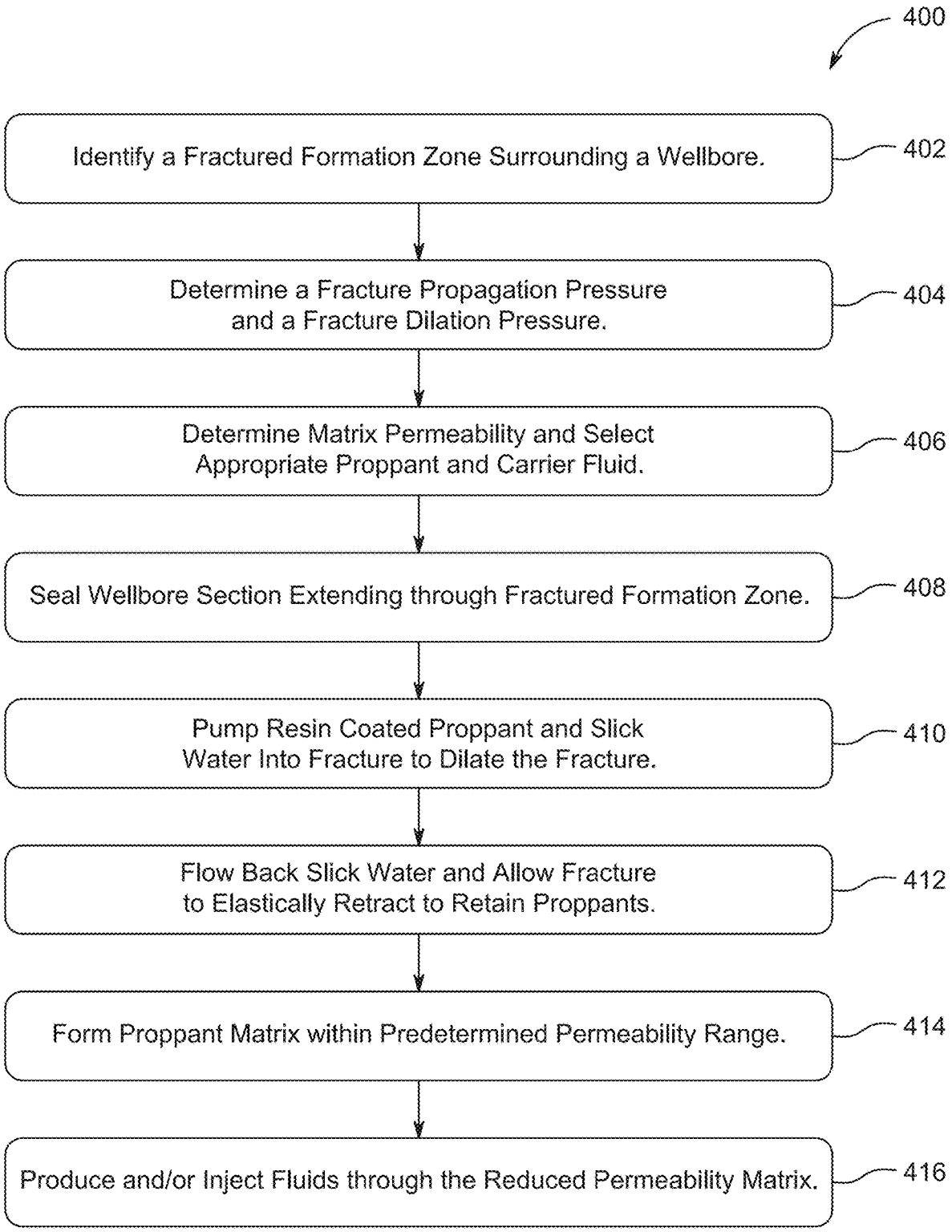
FIG. 4 is a flowchart illustrating the procedure for reducing the permeability of the fractured formation zone according to at least one aspect of the present disclosure.

FIG. 4 is a flowchart illustrating an example procedure 400 for reducing the permeability of the fractured formation zone 102 according to at least one aspect of the present disclosure. Reference is made to FIGS. 1 through 3B in describing the procedure 400.

Initially at step 402, a fractured formation zone 102 is identified surrounding a wellbore 104. In some embodiments, the fractured formation zone 102 may be identified by observing a loss in drilling mud 118 during a drilling operation. In other embodiments, other types of circulation fluids such as brine, freshwater, foams, etc. may be observed to be lost to a geologic formation "G" to indicate the presence of a fractured formation zone 102 with at least one fracture 124.

Next, at step 404, a fracture propagation pressure and a fracture dilation pressure may be determined. The fracture propagation pressure may be a pressure at which the geologic formation "G" plastically deforms or fractures, further extending the at least one fracture 124. The fracture dilation pressure may be a pore pressure or a formation pressure at which fluids may be introduced into the geologic formation "G," and which will elastically dilate the fracture 124. In some embodiments, the fracture propagation pressure and fracture dilation pressure may be determined empirically by rock geo-mechanical experiments. For example, geologic cuttings or other samples recovered from the fractured formation zone may be stress tested in a laboratory. In other embodiments, the fracture propagation pressure and fracture dilation pressure pressures may be estimated based on historical data from similar or nearby wellbores.

At step 406, a matrix permeability may be determined. The matrix permeability may be indicative of a permeability of the geologic formation surrounding the fracture 124. Those skilled in the art will recognize that a matrix permeability be determined empirically through laboratory tests and/or field tests. Laboratory tests may involve observing controlled fluid flow through a geologic sample from the fractured formation zone 102 and measuring a pressure drop or flow rate. Field tests may include percolation and pump tests. Once the matrix permeability is determined, an appropriate proppant 210 and carrier fluid may be selected based on the matrix permeability determined and/or the fracture propagation pressure and fracture dilation pressure determined. The proppant 210 may be selected such that the proppant 210 injected into the at least one fracture by the carrier fluid, at a pumping pressure between the fracture propagation pressure and fracture dilation pressure, provides a permeability through the proppant 210 that is substantially equal to, or within a predetermined range from (e.g., within 10 percent), the matrix permeability determined. The proppant 210 may be a resin coated sand, where the sand is sorted for roundness and/or grain size. Rounder grains of sand may not pack as tightly under pressure and thus may be selected when higher matrix permeabilities are determined. The permeability range may be designed by adjusting characteristics of the proppant 210 to an appropriate sorting and roundness. The designed proppants may be tested in the laboratory to ensure that the proppants will provide the predicted permeability before injecting downhole (see step 410 below). In some embodiments, mechanical sealants may be included within the carrier fluid and/or proppants 210.

Next, at step 408, a portion 206, 310 of a wellbore 104, 304, 322 extending through the fractured formation zone 102 may be isolated. A conveyance 202, 302 or drill string 108 may be run into the wellbore 104, 304, 322 and at least one isolation member 204, 308*a*, 308*b* may be radially extended to engage the geologic formation "G" and fluidly isolate the wellbore portion 206, 310. The wellbore portion 206, 310 may include at least one fracture 124.

At step 410, the selected proppant 210 and carrier fluid, e.g., resin coated sand and slick water, may be pumped through the conveyance 202, 302 or drill string 108 and discharged into the isolated wellbore portion 206, 310. A pumping pressure may be selected that is above the fracture dilation pressure and below the fracture propagation such that the fracture 124 is dilated and receives the proppant 210 therein. The pumping pressure may pressurize the isolated wellbore portion 206, 310 such that the proppant 210 is injected hundreds of feet or more into the fracture 124. In some embodiments, pumping may continue until a predetermined volume of proppant 210 and carrier fluid is pumped into the wellbore 104, 304, 322.

At step 412, the pumping may be discontinued, and the slick water and other carrier fluid may be allowed to flow back. With the pumping pressure discontinued, the fracture 124 may retract from the dilated configuration and secure the proppant 210 therein. In some embodiments, the at least one isolation member 204, 308*a*, 308*b* may then be disengaged from the geologic formation "G" and the conveyance 202, 302 may be run out of the wellbore 104, 304, 322 or drilling may be continued with the drill string 108. At step 414, the retraction of the fracture 124 may form a proppant matrix within the fracture 124 that has a permeability near the matrix permeability or within the predetermined permeability range.

At step 416, fluids may be produced and/or injected through the proppant matrix. In some embodiments one or more inflow control devices (ICDs), valves or other mechanical flow control devices (not shown) may be installed in the wellbore 104, 304, 322 and the fluids may be produced and/or injected through the mechanical flow control devices. In a dry oil zone, the proppant matrix formed by the proppants 210 will allow an injected fracture fluid to flow with better equalized drawdown. In a matured zone, where the proppants 210 may have been pumped down with mechanical sealants, the proppant matrix may delay water breakthrough as well as reduce the water coning as the proppant matrix within the fracture 124 may reduce water production and control the water production after the water encroachment. In an injection wellbore, the proppant matrix may reduce the permeability of the at least one fracture and equalize thief zones, fractured zones, with other matrix zones of the geologic formation "G" to distribute fluids along the wellbore and maximize areal sweep in the injection-to-production area.

Embodiments disclosed herein include:

A. A method for reducing permeability in a fractured formation zone through which a wellbore extends can include the steps of (a) identifying the fractured formation zone in the wellbore, the fractured formation zone including at least one fracture extending into a geologic formation surrounding the wellbore, (b) determining a fracture dilation pressure at which the at least one fracture may receive a fluid and a fracture propagation pressure at which the at least one fracture would be extended, (c) selecting a proppant including a resin-coated sand configured to form a proppant matrix with a permeability within a predetermined range of a matrix permeability of the geologic formation surrounding the wellbore, (d) running a tubular conveyance into the wellbore, the tubular conveyance carrying at least one isolation member, (e) isolating a portion of the wellbore containing the at least one fracture by actuating the isolation member to engage the geologic formation and seal a boundary of the wellbore portion, (f) pumping a proppant slurry comprising the selected proppant and a carrier fluid through the tubular conveyance into the isolated wellbore portion at a pumping pressure that is greater than the fracture dilation pressure and less than the fracture propagation pressure, wherein the pumping pressure elastically dilates the at least one fracture to permit the proppant slurry to be injected therein and (g) discontinuing the pumping to allow the carrier fluid to flow back from the isolated wellbore portion, whereby the at least one fracture elastically contracts to secure the proppant in place and form a proppant matrix that reduces the permeability of the fractured formation zone.

B. A system for reducing the permeability of a fractured formation zone through which a wellbore extends includes can include a tubular conveyance configured for insertion into the wellbore and at least one isolation member carried by the conveyance and actuatable to isolate a wellbore portion containing at least one fracture extending into a surrounding geologic formation. A source of a proppant slurry can be fluidly coupled to the tubular conveyance, the proppant slurry including a selected proppant and a carrier fluid wherein the proppant is selected to form a proppant matrix that reduces the permeability of the fractured formation zone. The system can also include a pump operable to deliver the proppant slurry from the source to the wellbore portion isolated by the at least one isolation member at a pumping pressure that is i) greater than a fracture dilation pressure at which the at least one fracture would receive the proppant slurry therein and ii) less than a fracture propagation pressure at which the at least one fracture would be extended.

C. A method for reducing permeability in a fractured formation zone through which a wellbore extends can include (a) selecting a proppant including a resin-coated sand configured to form a proppant matrix with a permeability within a predetermined range of a matrix permeability of the geologic formation surrounding the wellbore, (b) running a tubular conveyance into the wellbore, the tubular conveyance carrying at least one isolation member, (c) isolating a portion of the wellbore containing the at least one fracture by actuating the isolation member to engage the geologic formation, (d) pumping a proppant slurry comprising the selected proppant and a carrier fluid through the tubular conveyance into the isolated wellbore portion at a pumping pressure that is less than the fracture propagation pressure at which at least one fracture within the fractured formation zone would be extended such that the selected proppant is injected into the at least one fracture and (e) injecting the selected proppant into the at least one fracture by pressurizing the proppant slurry in the isolated wellbore portion with a pumping pressure that is less than the fracture propagation pressure at which at least one fracture would be extended and (f) forming a proppant matrix within the at least one fracture with the selected proppant, wherein the proppant matrix reduces the permeability of the fractured formation zone.

Each of embodiments A, B, and C may have one or more of the following additional elements in any combination: Element 1: wherein the at least one isolation member includes uphole and downhole isolation members of a straddle packer, and wherein isolating the portion of the wellbore includes engaging the downhole isolation element with the geologic formation downhole of the at least one fracture and engaging the uphole isolation element with the geologic formation uphole of the at least one fracture. Element 2: wherein the tubular conveyance is a drill string carrying the straddle packer uphole of a drill bit, and wherein the method further comprises drilling into the fractured formation zone with the drill bit. Element 3: wherein identifying the fractured formation zone includes observing as loss of drilling fluids while drilling into the fractured formation zone. Element 4: wherein the predetermined range is within 10 percent of the matrix permeability of the geologic formation surrounding the wellbore. Element 5: wherein the resin-coated sand is selected based on grain size and roundness to configure the proppant to form a matrix having a permeability within 10 percent of the matrix permeability. Element 6: wherein the carrier fluid is slick water and wherein pumping the proppant slurry includes pumping the resin coated sand within the slick water. Element 7: further comprising pumping the proppant slurry until a predetermined volume of the proppant slurry is injected into the isolated wellbore portion. Element 8: further comprising resuming drilling operations in the wellbore subsequent to formation of the proppant matrix. Element 9: further comprising producing or injecting fluids through the proppant matrix subsequent to formation of the proppant matrix.

Element 10: wherein the selected proppant includes a resin coated sand having a gran size and roundness predetermined to reduce the permeability of the fractured formation zone to a predetermined range of a matrix permeability of the geologic formation. Element 11: wherein the predetermined range is within 10 percent of a matrix permeability of the geologic formation. Element 12: wherein the selected carrier fluid includes a water-based slick water including a friction reducer. Element 13: wherein the at least one isolation member includes a straddle packer including an uphole isolation member and a downhole isolation member spaced from one another on the tubular conveyance. Element 14: wherein the tubular conveyance includes at least one of a drill string and a coiled tubing.

Element 15: wherein isolating the portion of the wellbore includes engaging a downhole isolation element of a straddle packer with the geologic formation downhole from the at least one fracture and engaging an uphole isolation element with the geologic formation uphole of the at least one fracture. Element 16: further comprising carrying the straddle packer on a drill string uphole of a drill bit and drilling into the fractured formation zone with the drill bit. Element 17: wherein pumping a proppant slurry comprises pumping a resin-coated sand in slick-water.

By way of non-limiting example, exemplary combinations applicable to A, B, and C include: Element 1 with Element 2; Element 2 with Element 3; Element 4 with Element 5; Element 5 with Element 6; Element 6 with Element 7; Element 7 with Element 8; Element 10 with Element 11, Element 11 with Element 12, Element 13 with Element 14, Element 15 with Element 16 and Element 15 with Element 17.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A method for reducing permeability in a fractured formation zone through which a wellbore extends, the method comprising:

identifying the fractured formation zone in the wellbore, the fractured formation zone including at least one fracture extending into a geologic formation surrounding the wellbore;

determining a fracture dilation pressure at which the at least one fracture would receive a fluid therein and a fracture propagation pressure at which the at least one fracture would be extended;

selecting a proppant including a resin-coated sand configured to form a proppant matrix within the at least one fracture, the proppant matrix having a permeability within a predetermined range of a matrix permeability corresponding to the geologic formation and providing a decrease in permeability within the at least one fracture;

running a tubular conveyance into the wellbore, the tubular conveyance carrying at least one isolation member;

isolating a portion of the wellbore containing the at least one fracture by actuating the isolation member to engage the geologic formation and seal a boundary of the portion of the wellbore;

pumping a proppant slurry comprising the selected proppant and a carrier fluid through the tubular conveyance into the isolated wellbore portion at a pumping pressure that is greater than the fracture dilation pressure and less than the fracture propagation pressure, wherein the pumping pressure elastically dilates the at least one fracture to permit the proppant slurry to be injected therein; and discontinuing the pumping to allow the carrier fluid to flow back from the portion of the wellbore, whereby the at least one fracture elastically contracts to secure the proppant in place and form a proppant matrix that reduces the permeability of the fractured formation zone.

2. The method of claim 1, wherein the at least one isolation member includes uphole and downhole isolation members of a straddle packer, and wherein isolating the portion of the wellbore includes:

engaging the downhole isolation element with the geologic formation downhole of the at least one fracture; and engaging the uphole isolation element with the geologic formation uphole of the at least one fracture.

3. The method of claim 2, wherein the tubular conveyance is a drill string carrying the straddle packer uphole of a drill bit, and wherein the method further comprises drilling into the fractured formation zone with the drill bit.

4. The method of claim 3, wherein identifying the fractured formation zone includes observing a loss of drilling fluids while drilling into the fractured formation zone.

5. The method of claim 1, wherein the predetermined range is within 10 percent of the matrix permeability of the geologic formation surrounding the wellbore.

6. The method of claim 5, wherein the resin-coated sand is selected based on grain size and roundness to configure the proppant to form a matrix having a permeability within 10 percent of the matrix permeability.

7. The method of claim 6, wherein the carrier fluid is slick water and wherein pumping the proppant slurry includes pumping the resin coated sand entrained within the slick water.

8. The method of claim 7, further comprising pumping the proppant slurry until a predetermined volume of the proppant slurry is injected into the isolated wellbore portion.

9. The method of claim 8, further comprising resuming drilling operations in the wellbore subsequent to formation of the proppant matrix.

10. The method of claim 1, further comprising producing or injecting fluids through the proppant matrix subsequent to formation of the proppant matrix.

11. A method for reducing permeability in a fractured formation zone through which a wellbore extends, the method comprising:

selecting a proppant including a resin-coated sand configured to form a proppant matrix within at least one fracture in the fractured formation zone, the proppant matrix having a permeability within a predetermined range of a matrix permeability corresponding to the geologic formation surrounding the wellbore and providing a decrease in permeability within the at least one fracture;

running a tubular conveyance into the wellbore, the tubular conveyance carrying at least one isolation member;

forming an isolated wellbore portion containing the at least one fracture by actuating the isolation member to engage the geologic formation;

pumping a proppant slurry comprising the selected proppant and a carrier fluid through the tubular conveyance into the isolated wellbore portion;

injecting the selected proppant into the at least one fracture by pressurizing the proppant slurry in the isolated wellbore portion with a pumping pressure that is less than the fracture propagation pressure at which at least one fracture would be extended; and forming a proppant matrix within the at least one fracture with the selected proppant, wherein the proppant matrix reduces the permeability of the fractured formation zone.

12. The method of claim 11, wherein isolating the portion of the wellbore includes engaging a downhole isolation element of a straddle packer with the geologic formation downhole from the at least one fracture and engaging an uphole isolation element with the geologic formation uphole of the at least one fracture.

13. The method of claim 12, further comprising carrying the straddle packer on a drill string uphole of a drill bit and drilling into the fractured formation zone with the drill bit.

14. The method of claim 12, wherein pumping the proppant slurry comprises pumping a resin-coated sand in slickwater.

* * * * *